US005310037A

United States Patent [19]

Guey

[11] Patent Number: 5,310,037

[45] Date of Patent: May 10, 1994

[54] AUTOMATIC LOADING MECHANISM FOR ELECTROPLATING

[76] Inventor: Yu C. Guey, P.O. Box 82-144, Taipei, Taiwan

[21] Appl. No.: 961,415

[22] Filed: Oct. 15, 1992

[51] Int. Cl.[5] ..... B65G 21/20

[52] U.S. Cl. ..... 198/345.2; 198/395; 198/437

[58] Field of Search ..... 198/395, 445, 437, 442, 198/465.1, 345.3, 345.2, 345.1

[56] References Cited

U.S. PATENT DOCUMENTS 4,619,356 10/1986 Dean et al. ..... 198/395
4,801,043 1/1989 Cindric ..... 198/395 X

FOREIGN PATENT DOCUMENTS 0056413 5/1981 Japan ..... 198/395
0051610 3/1982 Japan ..... 198/395
0169409 7/1986 Japan ..... 198/395
0101211 5/1988 Japan ..... 198/395

*Primary Examiner*—D. Glenn Dayoan
*Attorney, Agent, or Firm*—Alfred Lei

[57] ABSTRACT

This invention relates to an automatic loading mechanism for electroplating and in particular to one utilizing an inspecting means to inspect the orientation of the workpiece from the vibration, a turning device to transmit the workpiece to an outlet, an elevating mechanism and a pushing mechansim to push the workpiece between two pins of the hook, whereby the products to be plated may be automatically loaded on the fly bar thus increasing the production rate and saving a lot of labor work.

1 Claim, 9 Drawing Sheets

AUTOMATIC LOADING MECHANISM FOR ELECTROPLATING

BACKGROUND OF THE INVENTION

It is found that the presently used loading method for electroplating is simply achieved by means of manual power. Hence, a lot of man power is required for the operation thereby increasing the cost and decreasing the production rate.

Therefore, it is an object of the present invention to provide an automatic loading mechanism for electroplating which may obviate and mitigate the above-mentioned drawbacks.

SUMMARY OF THE INVENTION

This invention relates to an automatic loading mechanism for electroplating.

It is the primary object of the present invention to provide an automatic loading mechanism for electroplating which may automatically load the workpiece to the fly bar.

It is another object of the present invention to provide an automatic loading mechanism for electroplating which may increase the efficiency and save a lot of labor.

It is another object of the present invention to provide an automatic loading mechanism for electroplating which may be mounted on any kind of electroplating production line.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
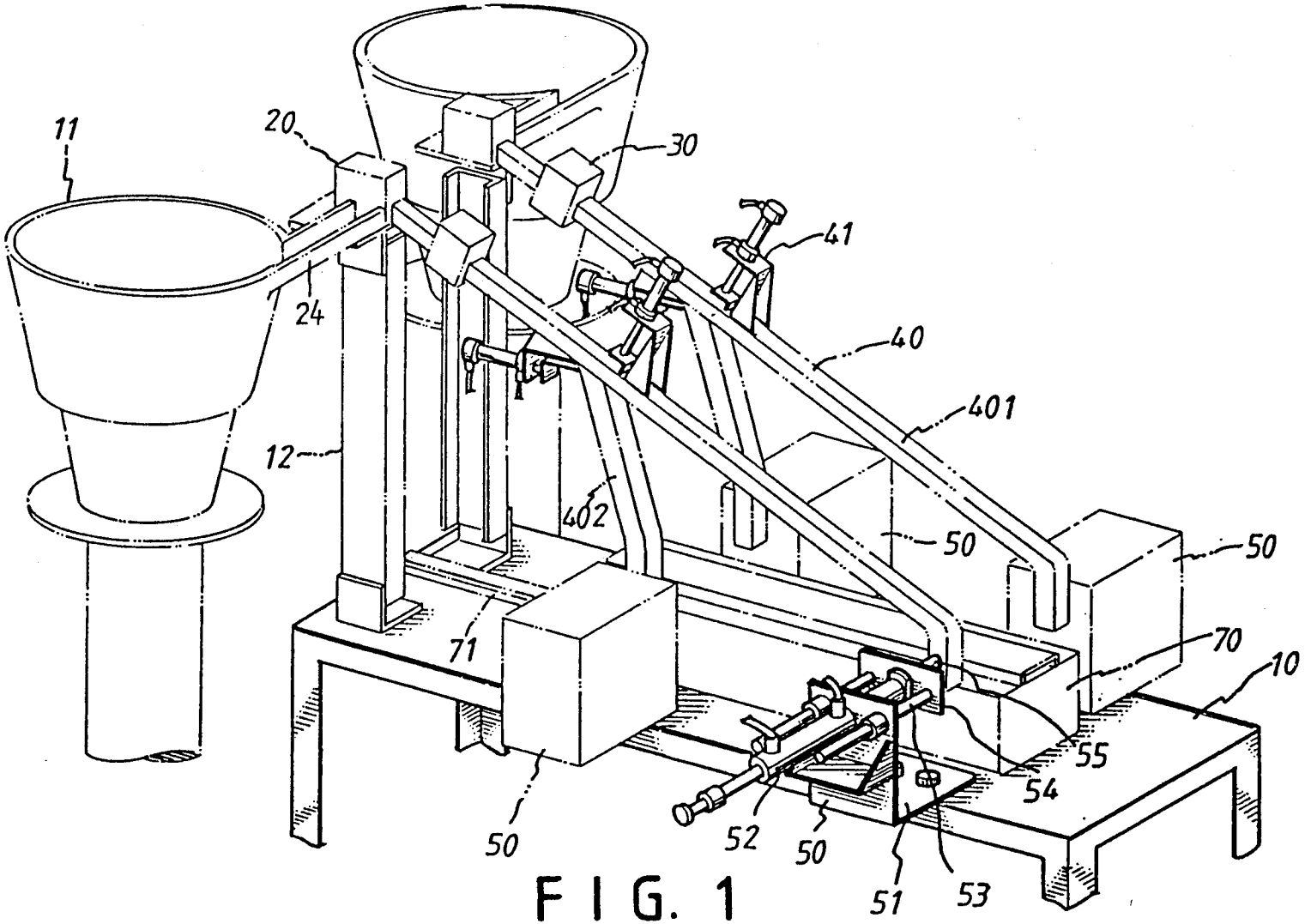
FIG. 1 is a perspective view of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
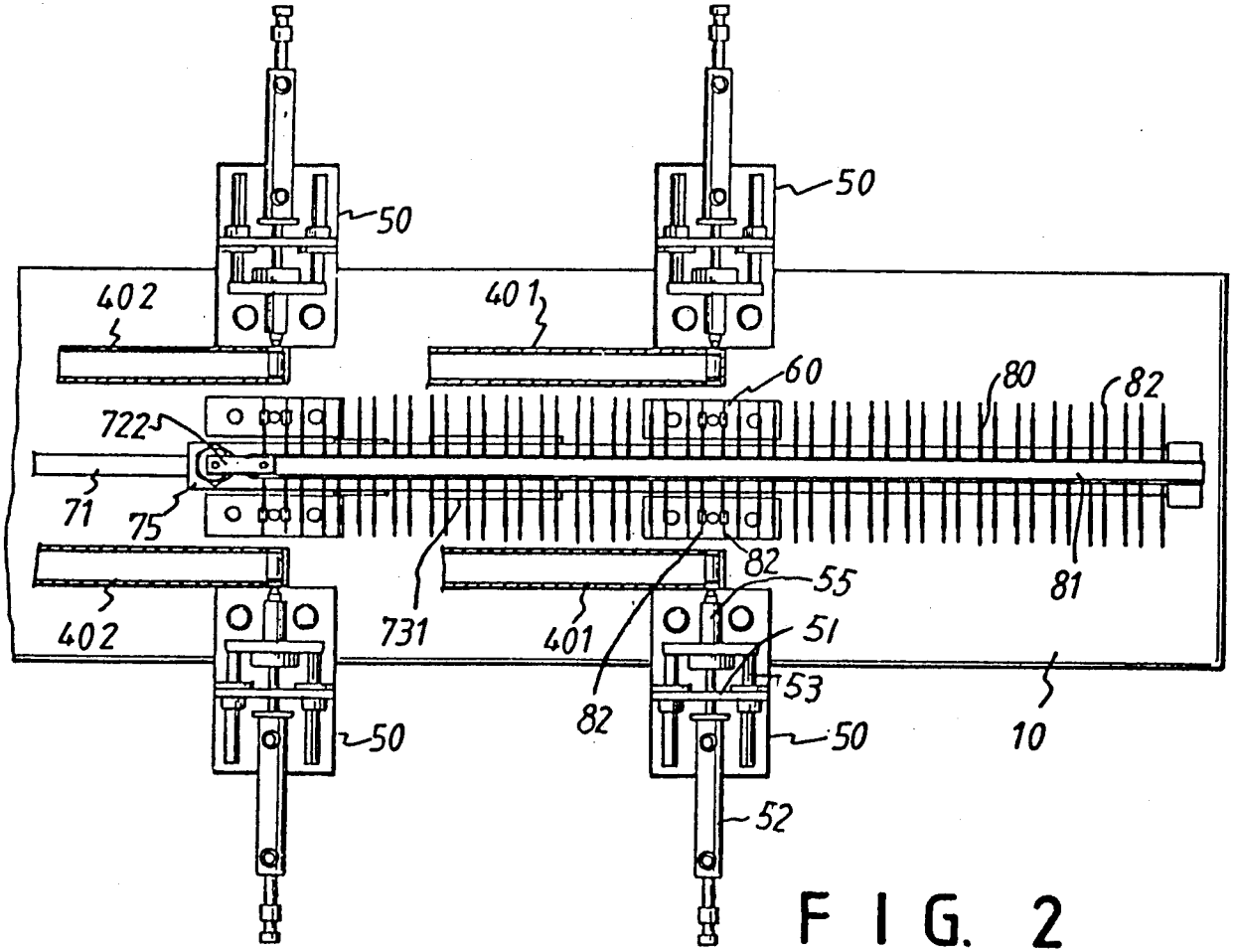
FIG. 2 is a top view of the present invention.

With reference to the drawings and in particular to FIGS. 1 and 2 thereof, the present invention mainly comprises a platform 10, two vibrators 11 each at one side of the platform 10, and two racks 40 connecting the vibrators 11 with the platform 10. The racks 40 are fixedly mounted on a bracket 12 and is provided with an inspecting means 20, a turning means 30 and a separating means 41. The outlet of the rack 40 is just located above a positioning means 70 of the platform 10. Further, the platform 10 has four pushing mechanisms 50 and elevating means 60. The hooks 80 for holding the workpiece 90 to be plated are mounted above the platform 10.

Figure 3:
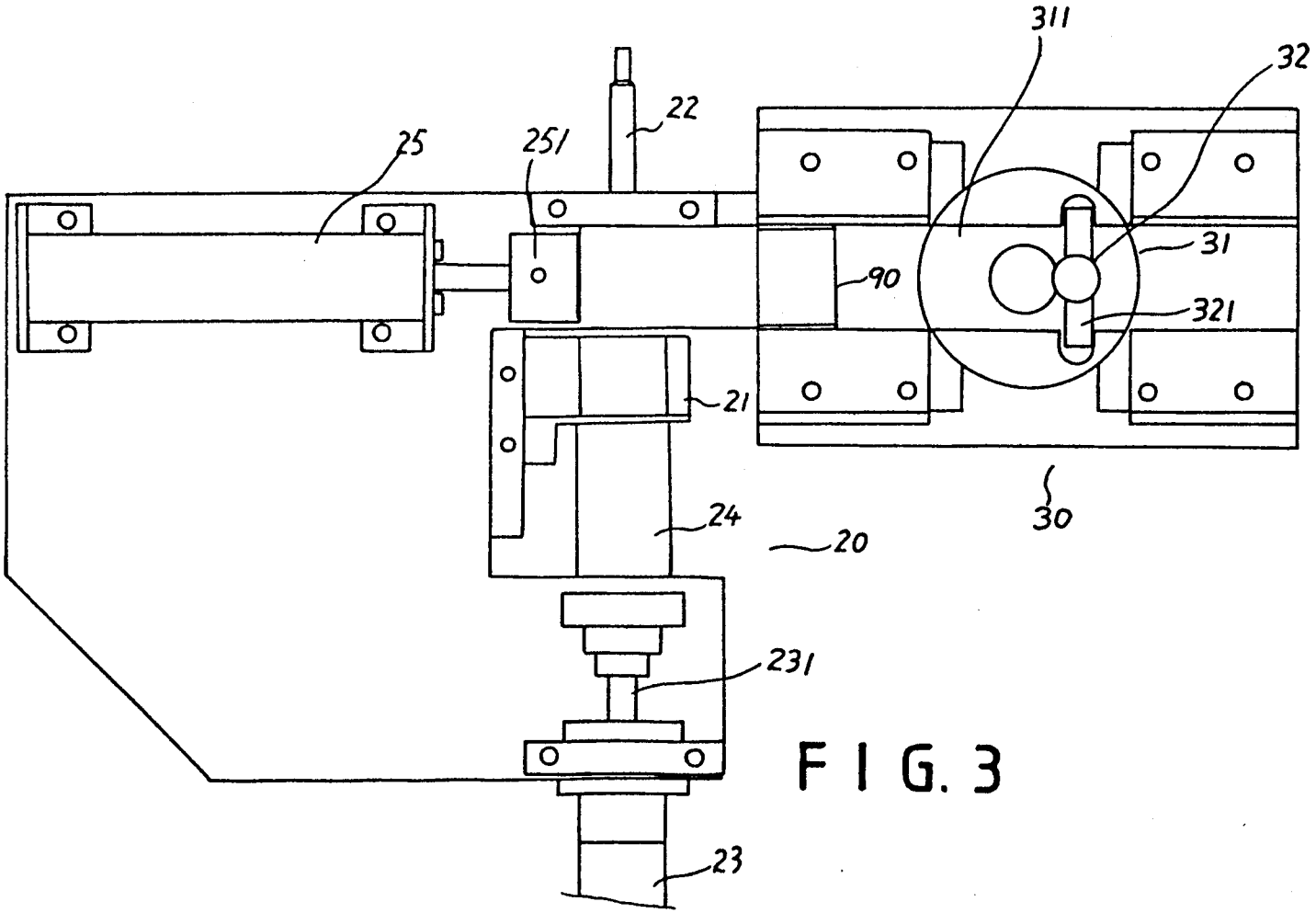
FIG. 3 is a top view of the inspecting means and the turning means.
Figure 4:
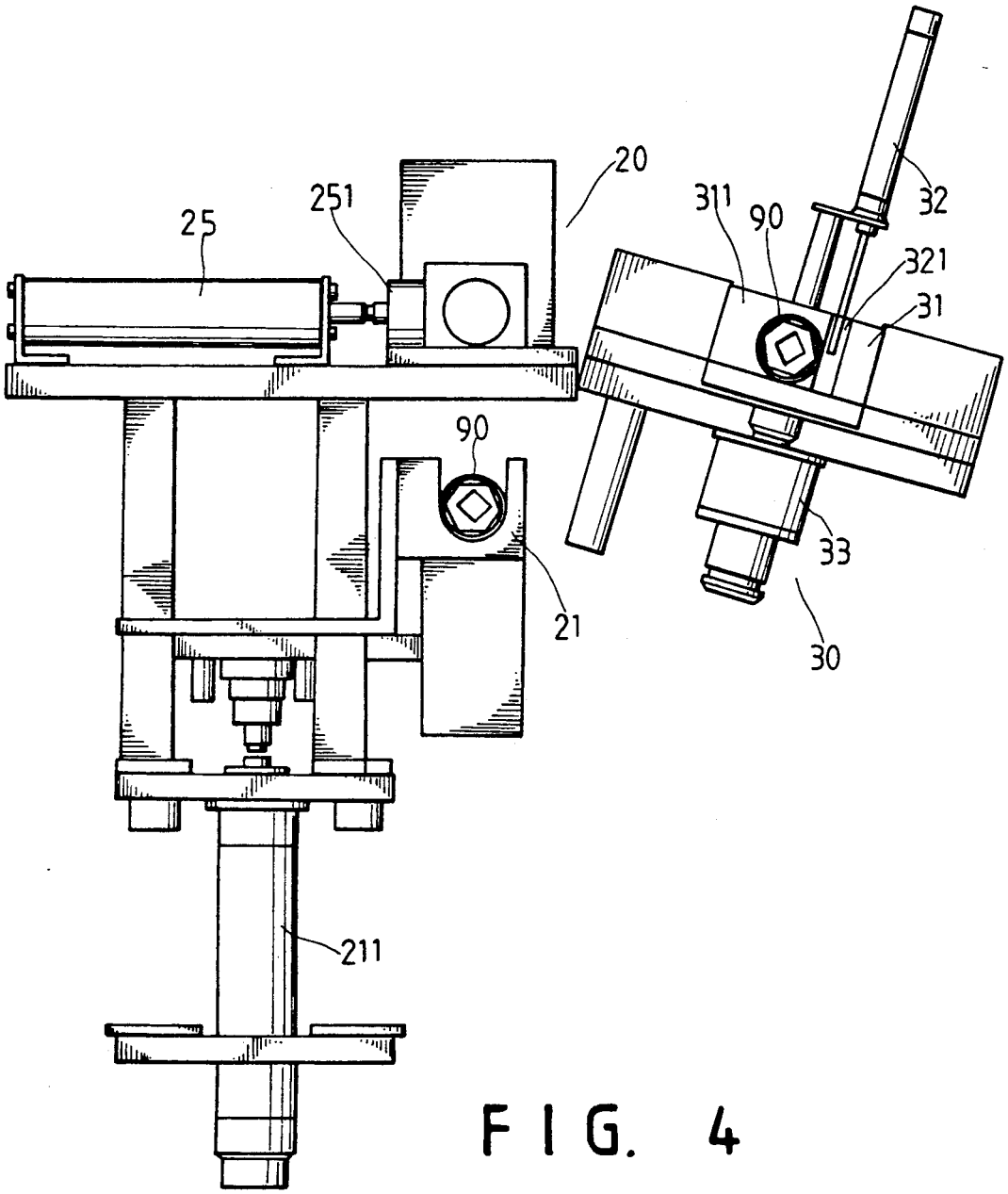
FIG. 4 is a side view of the inspecting means and the turning means.

Looking now at FIGS. 3 and 4, the inspecting means 20 is connected with the outlet of the vibrator 11 via an outlet plate 24 so that the workpiece 90 may be transmitted to a fixing frame 21. Further, the fixing frame 21 is connected with a cylinder 211 so that only one workpiece 90 may be transmitted and the other workpiece 90 may be stopped at the out]et p)ate 24. The elevating fixing frame 21 may just cease in front of the inspecting means 22 for inspecting the direction of the workpiece 90. Then, the workpiece 90 is pushed forward by a rod 231 of the cylinder 23. Thereafter, a second cylinder 25 will push the workpiece 90 to the turning means 30. Meanwhile, in case the direction of the workpiece 90 is correct, the workpiece 90 will be transmitted to a passage 311 of a turning disc 31 of the turning means 30. Then, the workpiece 90 will enter into a passage 40 through the turning disc 31. If the direction of the workpiece 90 is wrong, the cylinder 32 on the turning disc 31 will lower a stop plate 321 and the cylinder 25 will urge a pusher 251 to push the workpiece 90 thereby preventing the wrongly disposed workpiece 90 from passing through the turning disc 31 to the passage 40. Afterwards, the cylinder 33 will rotate the turning disc 31 and the cylinder 32 will draw back a stop plate 321. Then, the workpiece 90 will drop down into the passage 40 and the turning disc 31 will recover its position for next inspection.

Figure 5:
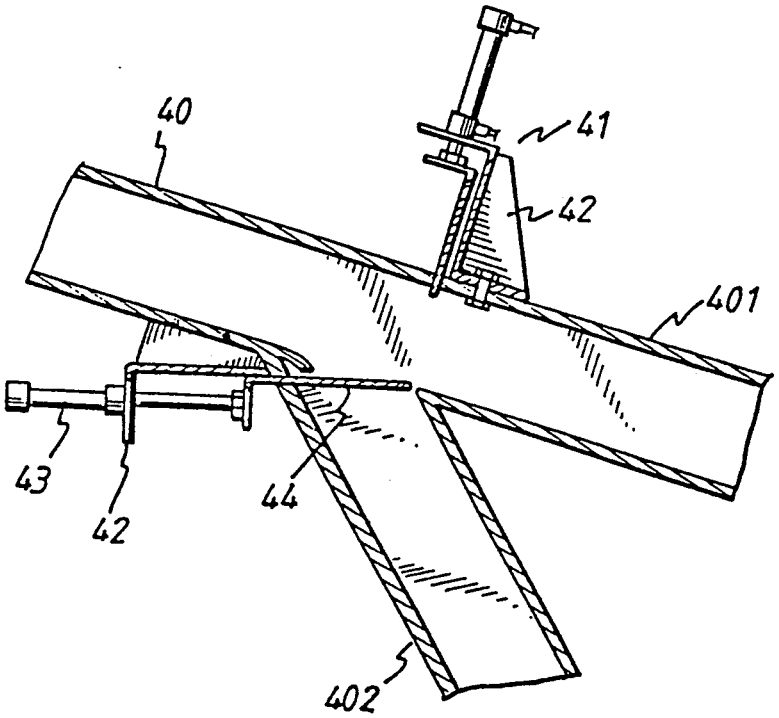
FIG. 5 is sectional view of the separating means.

As illustrated in FIGS. 1 and 5, the passage 40 has a front passage 401 and a branch passage 402 each of which is provided with a separating means 41. The separating means 41 has a bracket 42 on which there is a cylinder 43 with a shutter 44 for closing the front passage 401 or the branch passage 402.

Figure 6:
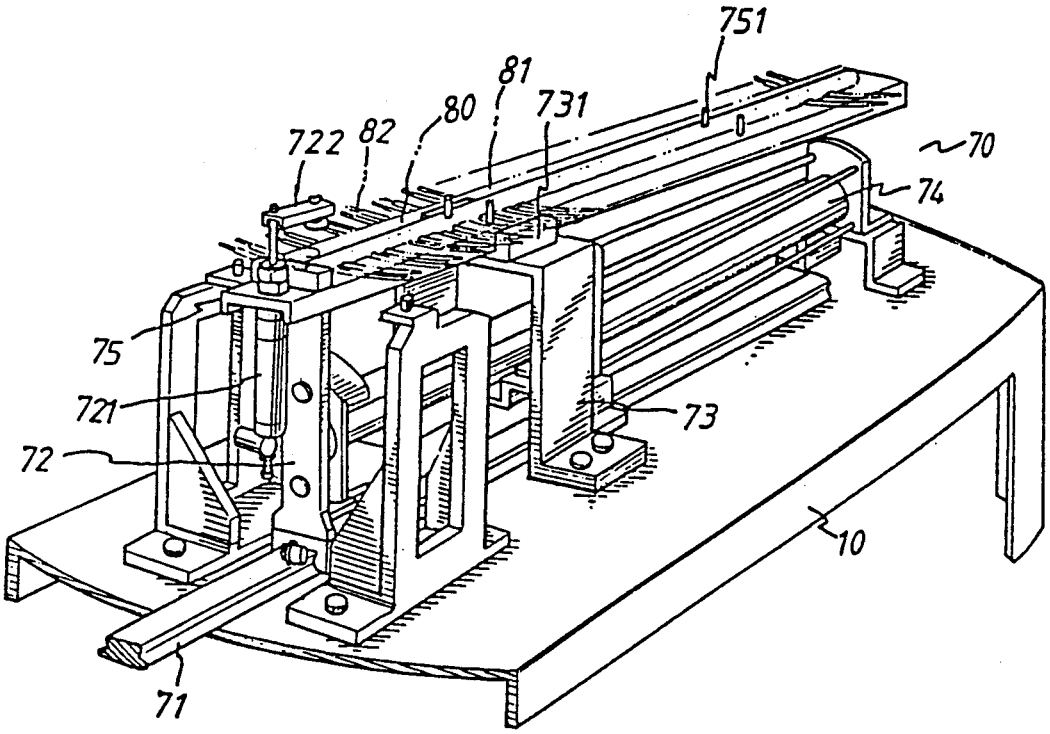
FIG. 6 is a perspective view of the platform.

Turning to FIGS. 1 and 6, the platform 10 is provided with a positioning means 70 and a rack 71. The bracket 72 is connected with the rack 71 at the lower end and driven by a main shaft transmission device 74 on the platform 10. Further, the bracket 72 has a sliding plate 75 which is provided at one end with a cylinder 721 and a plurality of pins 751 on the top. An engaging member 722 is mounted on the cylinder 721 and a bracket 73 is installed on the platform 10. The top of the bracket 73 has a guiding seat 731 for guiding the sliding plate 75. As shown in FIG. 2, the hook 80 is provided with a fly bar 81 and a plurality of pins 82 perpendicular to the fly bar 81. Most portion of the fly bar 81 and the pins 82 are coated with a non-conductive material so that only a small area thereof is conductive. The hook 8 is mounted on the sliding plate 75 and kept in position by the pins 751. Further, the hook 8 is kept in a fixed position by the engaging member 722 of the cylinder 721.

Figure 7:
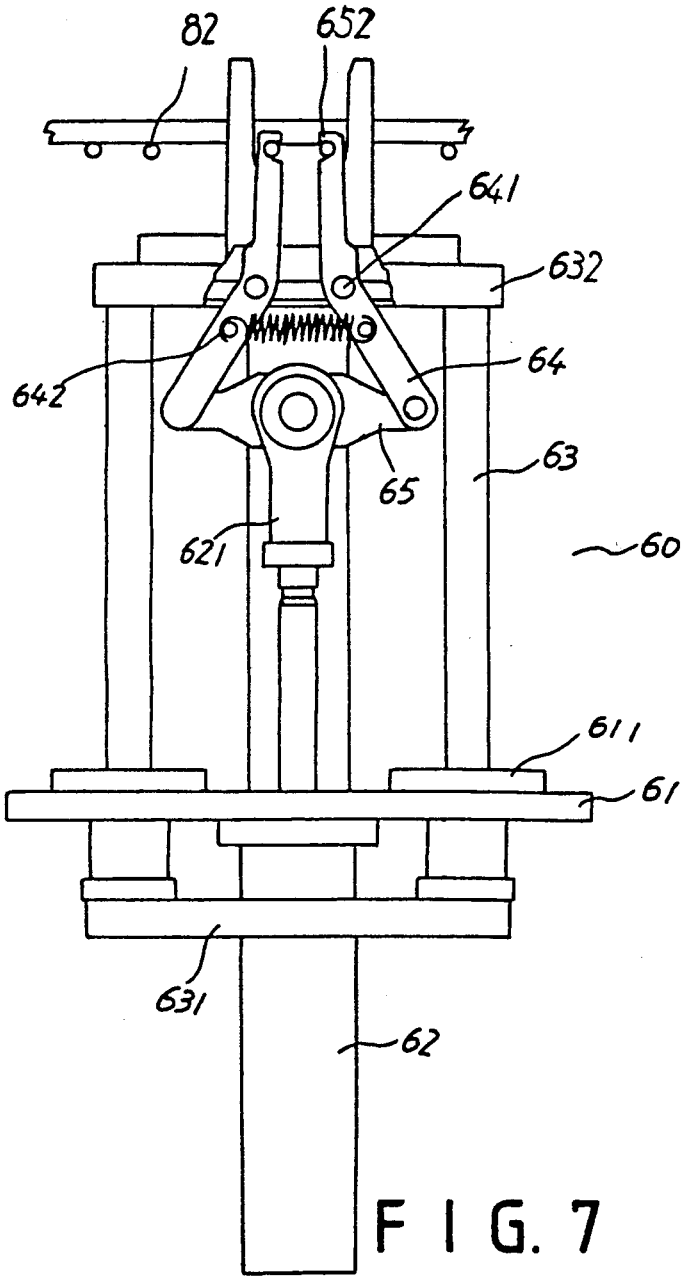
FIG. 7 is a front view of the elevating means.

Referring to FIGS. 1, 2 and 7, the elevating means 60 is mounted on the platform 10 and disposed near the front passage 401 and the branch passage 402 and under the supporting rods 82. The elevating means 60 includes a plate 61 on which there are two seats 611, two guiding rods 63 mounted on the seats 611, an upper plate 632, a lower plate 631 and a cylinder 62 arranged on the plate 61. A universal joint 621 is pivotally connected with a driving member 65 which is connected with two clamping arms 64 which are in turn pivotally connected with the upper plate 632 by pins 641. Between the two clamping arms 64 there is a spring 642. Further, the end of the clamping arms 64 is formed with a recess 652 engaged with the supporting rod 82.

As shown in FIGS. 1 and 2, the pushing mechanism 50 has a bracket 51 fixedly mounted on the platform 10. On the bracket there is a cylinder 52 connected with a plate 54. Further, the cylinder 52 has a push rod 55 extending through the plate 54 and disposed against the outlets of the front passage 401 and the branch passage 402 and two supporting rods 82 of the hook 80.

When in operation, the vibrator 11 will transmit the workpiece 90 to the inspecting means 20 through the outlet plate 24. If the workpiece 90 is correctly oriented, the pusher 251 of the cylinder 25 will push the workpiece 90 into the passage 40 In case the workpiece 90 is wrongly oriented, the cylinder 32 of the turning means 30 will move the stop plate 321 down into the passage 311 so as to keep the workpiece 90 in the passage and the cylinder 33 will be rotated to turn the workpiece 90 through an angle of 180 degrees. Then the workpiece 90 will be further transmitted to the separating means 41 (see FIG. 5) in which the cylinders 43 will control the shutters 44 to open the front passage 401 and the branch passage 402 alternately thereby equally dispensing the workpiece 90 into the front passage 401 and the branch passage 402. In addition, there is a detector, (not shown) in the front passage 401 and the branch passage 402 for controlling the vibrators 11 to stop feeding when the workpieces 90 in the passages 401 and 402 exceed a predetermined amount.

Figure 8:
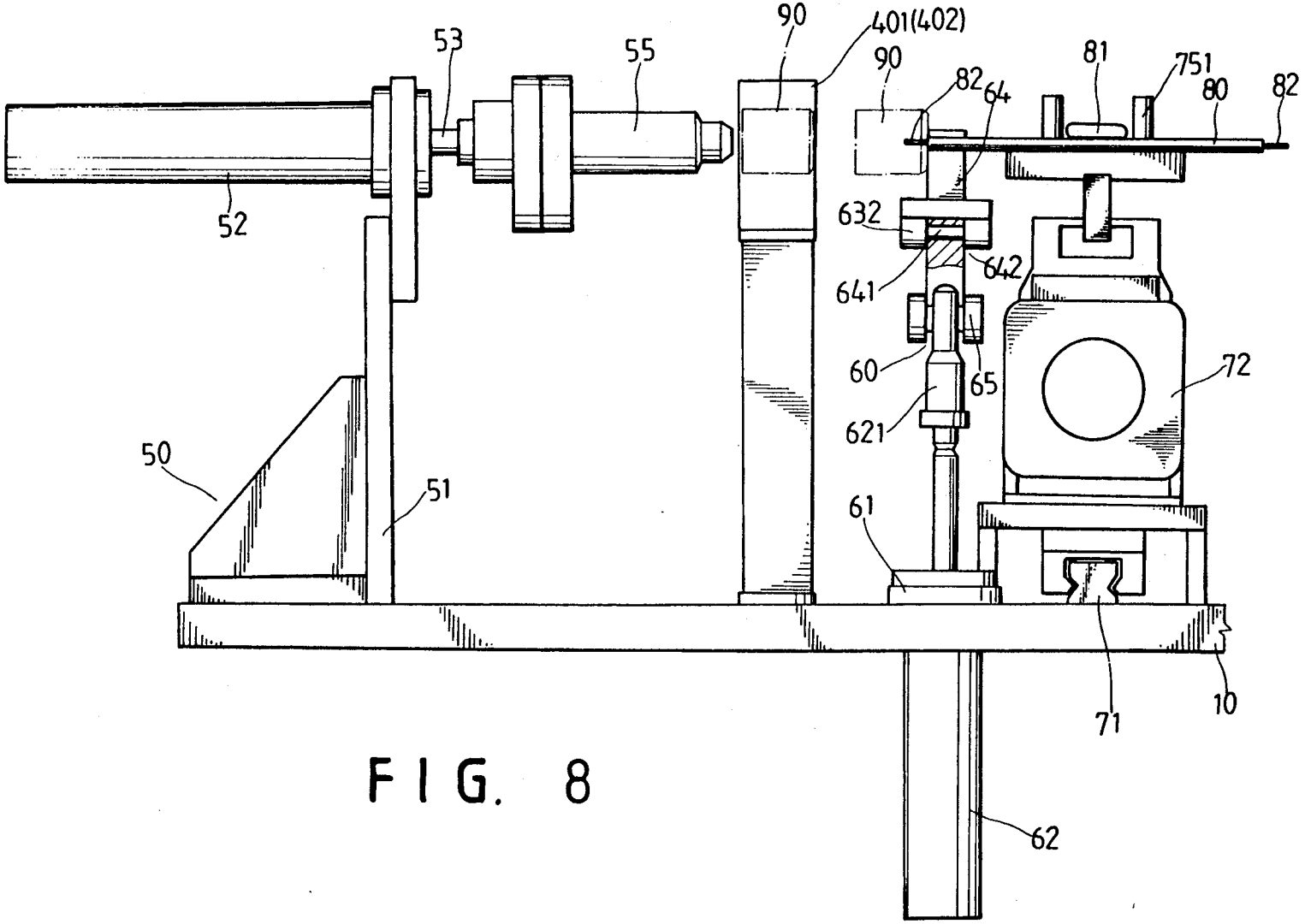
FIG. 8 working the working principle of the present invention.
Figure 9:
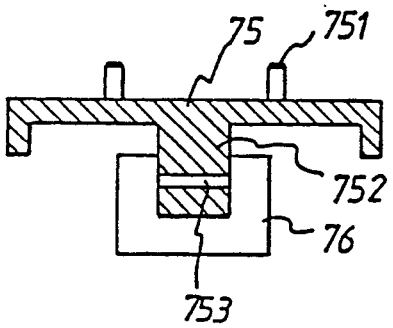
FIG. 9 shows the engagement between the sliding plate and the seat.

As illustrated in FIGS. 6, 8 and 9, the hook 80 is mounted on the pins 751 of the sliding plate 75 and kept in position by the engaging member 722. Moreover, the lower portion of the sliding plate 75 has an elongated protrusion 752 which is provided with a plurality of perforations 753 and adapted to a seat 76 with a detector (not shown) so that the sliding plate 75 will be stopped when moved to the next perforation 753. In the meantime, the cylinder 62 of the elevating means 60 will control the two clamping arms 64 to hold two pins 82. Then, the push rod 55 of the pushing mechanism 50 will push the workpiece 90 between the two pins 82. Thereafter, the pushing mechanism 50 and the clamping means 60 return to their orginal positions for next operation.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An automatic loading mechanism for electroplating comprising:

a platform having two racks connecting two vibrators with said platform, said racks being fixedly mounted on a bracket and each said rack provided with an inspecting means, a turning means and a separating means, said inspecting means being connected with an outlet of one of said vibrators via an outlet plate so that a workpiece may be transmitted to a fixing frame, said bracket having a sliding plate which is provided at one end with a cylinder and a plurality of pins on a top;

an elevating means mounted on said platform and disposed near a front passage and a branch passage and under supporting rods, said elevating means including a plate on which there are two seats, two guiding rods mounted on the seats, an upper plate, a lower plate, a cylinder arranged on the plate on which are mounted said two seats, and a universal joint pivotally connected with a driving member engaged with two clamping arms, said clamping arms being in turn connected with the upper plate and having a spring therebetween and being provided at the end with a recess engaged with the supporting rod; and a pushing mechanism having a bracket fixedly mounted on said platform and a cylinder connected with a plate, said cylinder being provided with a push rod extending through the plate and disposed against the outlets of the front passage and the branch passage and two supporting rods of a hook.

* * * * *